US009593392B2

(12) United States Patent
John et al.

(10) Patent No.: US 9,593,392 B2
(45) Date of Patent: Mar. 14, 2017

(54) METHOD FOR PRODUCING WORKPIECES FROM LIGHTWEIGHT STEEL HAVING MATERIAL PROPERTIES THAT ARE ADJUSTABLE ACROSS THE WALL THICKNESS

(75) Inventors: Daniela John, Hannover (DE); Manuel Otto, Cremlingen (DE); Rune Schmidt-Jürgensen, Hannover (DE); Thomas Evertz, Peine (DE); Zacharias Georgeou, Wolfsburg (DE); Bianca Springub, Hannover (DE)

(73) Assignee: SALZGITTER FLACHSTAHL GMBH, Salzgitter (DE)

( * ) Notice: Subject to any disclaimer, the term of this patent is extended or adjusted under 35 U.S.C. 154(b) by 974 days.

(21) Appl. No.: 13/634,980

(22) PCT Filed: Feb. 10, 2011

(86) PCT No.: PCT/DE2011/000128
§ 371 (c)(1),
(2), (4) Date: Nov. 5, 2012

(87) PCT Pub. No.: WO2011/113404
PCT Pub. Date: Sep. 22, 2011

(65) Prior Publication Data

US 2013/0048150 A1 Feb. 28, 2013

(30) Foreign Application Priority Data

Mar. 16, 2010 (DE) ..... 10 2010 011 991
Aug. 10, 2010 (DE) ..... 10 2010 034 161

(51) Int. Cl.
*C21D 3/04* (2006.01)
*C21D 6/00* (2006.01)
(Continued)

(52) U.S. Cl.
CPC ..... *C21D 6/005* (2013.01); *C21D 8/0257* (2013.01); *C22C 38/04* (2013.01); *C22C 38/06* (2013.01);
(Continued)

(58) Field of Classification Search
CPC ..... C21D 6/005; C21D 8/0257; C21D 1/76; C21D 9/42; C21D 9/46; C23C 8/02; C22C 38/02; C22C 38/04; C22C 38/06
(Continued)

(56) References Cited

U.S. PATENT DOCUMENTS

2009/0196785 A1 8/2009 Spitzer et al.
2010/0000634 A1 1/2010 Spehr et al.

FOREIGN PATENT DOCUMENTS

DE 39 04 776 8/1990
DE 199 00 199 7/2000
(Continued)

*Primary Examiner* — Lois Zheng
(74) *Attorney, Agent, or Firm* — Henry M. Feiereisen LLC

(57) ABSTRACT

A method for producing a workpiece having properties which are adjustable across a wall thickness or strip thickness of the workpiece, includes the steps of subjecting the workpiece to a decarburizing annealing treatment under an oxidizing atmosphere and to an accelerated cooling and/or a cold forming for generating a property gradient of the workpiece, wherein the workpiece is made of an austenitic lightweight steel which has an alloy composition which includes by weight percent 0.2% to 1% carbon, 0.05% to<15% aluminum, 0.05% to 6.0% silicon, 9% to<30% manganese, and at least one element selected from the group consisting of chromium, copper, boron, titanium, zirconium, vanadium and niobium, wherein chromium=4.0%; tita-
(Continued)

nium+zirconium=0.7%; niobium+vanadium=0.5%, boron=1%, the remainder iron including common steel companion elements.

14 Claims, 2 Drawing Sheets

(51) Int. Cl.

| | |
|---|---|
| ***C21D 8/02*** | (2006.01) |
| ***C22C 38/04*** | (2006.01) |
| ***C22C 38/06*** | (2006.01) |
| *C21D 1/76* | (2006.01) |
| *C21D 9/42* | (2006.01) |
| *C21D 9/46* | (2006.01) |

(52) U.S. Cl.
CPC ..... *C21D 1/76* (2013.01); *C21D 9/42* (2013.01); *C21D 9/46* (2013.01)

(58) Field of Classification Search
USPC ..... 148/208
See application file for complete search history.

(56) References Cited

FOREIGN PATENT DOCUMENTS

| | | |
|---|---|---|
| DE | 101 24 594 | 12/2002 |
| DE | 102004061284 | 7/2005 |
| DE | 102007039013 | 8/2008 |
| EP | 0 489 727 | 8/1995 |
| EP | 0 573 641 | 9/1998 |
| EP | 0 944 433 | 12/2002 |

METHOD FOR PRODUCING WORKPIECES FROM LIGHTWEIGHT STEEL HAVING MATERIAL PROPERTIES THAT ARE ADJUSTABLE ACROSS THE WALL THICKNESS

CROSS-REFERENCES TO RELATED APPLICATIONS

This application is the U.S. National Stage of International Application No. PCT/DE2011/000128, filed Feb. 10, 2011, which designated the United States and has been published as International Publication No. WO 2011/113404 and which claims the priority of German Patent Application, Serial No. 10 2010 011 991.1, filed Mar. 16, 2010, and German Patent Application Serial No. 10 2010 034 161.4, filed Aug. 10, 2010 pursuant to 35 U.S.C. 119(a)-(d).

BACKGROUND OF THE INVENTION

The invention relates to a method for producing workpieces from lightweight steel having material properties that can be adjusted across the wall thickness.

In the following, workpieces relate to components or primary products for components such as for example strips, plates or pipes which are used for example in the field of machine construction, plant construction, steel construction and ship construction, and in particular motor vehicle construction.

Especially the very competitive automobile market forces the manufacturers to constantly seek solutions for lowering fleet consumption while maintaining a maximal comfort and safety of occupants. In this context the weight saving of all vehicle components on one hand plays a decisive role, but on the other hand also properties of the individual components which promote the safety of the passengers in the case of high static and dynamic stresses during operation and in case of a crash.

In recent years great advances have been made in the field of the so called lightweight steels which are characterized by a low specific weight and at the same time high strengths and tenacities (for example EP 0 489 727 B1, EP 0 573 641 B1, DE 199 00199 A1) and a high ductility and with this are of significant interest for vehicle construction.

In these steels, which are austenitic in the initial state, a weight reduction which is advantageous for the automobile industry, is achieved while maintaining the previous construction method, as a result of the high proportion of alloy components which have a specific weight which is far below the specific weight of iron (Mn, Si, Al).

For example, from DE 10 2004 061 284 A1 a lightweight steel is known with an alloy composition (in weight %):

| | |
|---|---|
| C | 0.04 to ≤1.0 |
| Al | 0.05 to <4.0 |
| Si | 0.05 to ≤6.0 |
| Mn | 9.0 to <18.0 |

remainder iron including usual steel tramp elements. Optionally Cr, Cu, Ti, Zr, V and Nb can be added depending on the requirements.

This known lightweight steel has a partially stabilized γ-mixed crystal structure with a defined stacking fault energy with a at times multiple TRIP-effect which transforms the tension- or expansion-induced transformation of a face centered γ-mixed crystal (austenite) into an ϵ-martensite (hexagonally densest sphere packing) which then in the course of further deformation transforms into a body centered α-martensite and residual austenite.

The high degree of deformation is achieved by TRIP (transformation induced plasticity) and TWIP (twinning induced plasticity) properties of the steel.

Numerous tests have shown that in the complex interaction between Al, Si, Mn the carbon content is of paramount significance. On one hand it increases the stacking fault energy and on the other hand expands the meta-stable austenite region. This allows influencing the deformation-induced martensite formation and the strengthening and ductility associated therewith.

With these lightweight steels client specifications can already be met to a great extend, however there is still the demand for performance-optimized workpieces made of lightweight steel which have material properties with regard to strength, tenacity, wear resistance and so forth which are correspondingly adjusted to the stresses expected to occur in the direction of the wall or plate thickness. An example for this are bullet proof vehicles in which the component has to have a hard surface layer for fending off projectiles and a layer underneath this surface layer with a high tenacity for a high energy-absorption capacity in case of being fired on.

A method for producing a composite strip made of steel is for example known from DE 101 24 594 A1. According to this, a ferritic core strip which is directly cast according to the two-roll method and plated with an austenitic or high-alloyed ferritic cold strip.

Pipes with different material properties across the wall thickness are known inter alia from EP 0 944 443 B1. Here, a pipe is inserted into another pipe and connected with the other pipe, wherein different materials are used for the outer and inner pipes.

A disadvantage of these known methods is the sharp step of the properties of the composite material due to the plating which complicates the adjustment to the respective properties to the corresponding requirements across the wall or strip thickness and the high costs for the manufacture of the plating. In addition the weight advantage of the lightweight steels is mostly lost by the plating with conventional steels.

A further method for producing a composite material is known from DE 39 04 776 C2 in which several layers of steel are interconnected by means of diffusion welding and these layers are alloyed by means of metalloids in a gas atmosphere in such a manner that a different concentration profile of the metalloids is established across the cross section of the flat product.

This allows adjusting different material properties across the cross section of the composite material with regard to strength and tenacity.

SUMMARY OF THE INVENTION

This method is also cost intensive and also has weight disadvantages compared to workpieces which are only made of lightweight steel.

Object of the invention is to propose a method for producing workpieces from austenitic lightweight steel with which different material properties can be adjusted in a simple and cost saving manner across the strip or wall thickness while retaining the weight advantage of the lightweight steel.

This object is solved with a method for producing a workpiece having properties which are adjustable across a wall thickness or strip thickness of the workpiece, wherein the workpiece is made of an austenitic lightweight steel which has an alloy composition inlcuding by weight percent 0.2% to 1% carbon, 0.05% to <15% aluminum, 0.05% to 6.0% silicon, 9% to <30% manganese, and at least one element selected from the group consisting of chromium, copper, boron, titanium, zirconium, vanadium and niobium, chromium=6.5%; titanium+zirconium=0.7%; niobium+vanadium=0.5%, boron=1%, the remainder iron including common steel companion elements, wherein the method includes the steps of subjecting the workpiece to a decarburizing annealing treatment under an oxidizing atmosphere thereby causing a ferritic or meta-stable austenitic structure to form in a surface proximate region of the workpiece; and subjecting the workpiece to an accelerated cooling and/or a cold forming for generating a property gradient of the workpiece, wherein a layer thickness and properties of the austenitic structure are adjustable via variation of at least one annealing parameter selected from the group consisting of temperature and holding time and via variation of at least one of a gas composition and a partial pressure of the atmosphere. Advantageous refinements and a device for producing hot strips are the subject matter of sub claims.

According to the teaching of the invention the component or primary product is subjected to a decarburizing annealing treatment under an oxidizing atmosphere in such a manner that a ferritic or meta-stable austenite structure forms in the surface-proximate regions, the layer thickness of which structure is adjustable via variations of the annealing parameters (temperature, holding time) and annealing atmosphere (gas composition, partial pressure), and is subjected to a subsequent accelerated cooling and/or cold forming for generating a property gradient.

The essence of the invention is to locally adjust a ferritic or ferritic-austenitic material by targeted decarburization, starting from the surface of the workpiece, in steel materials which, due to their alloy concept are permanently austenitic and have sufficiently high carbon contents, with which material all structural states of ferritic steels are producible by corresponding heating and cooling conditions. This includes the structure components ferrite, bainite and in particular martensite and carbide in different morphologies.

In addition, steels whose forming due to their chemical composition (stack fault energy) preferably occurs via the formation of twins (TWIP) can be converted from austenite to martensite (TRIP) after a targeted border decarburization locally at the surface.

In this case, for example when cold forming a steel plate, forming induced martensite with correspondingly high strength can be generated in the decarburized regions. Initially an instable austenite is present in the targeted decarburized border region which shows the TRIP-effect after forming.

In tests a border decarburization was established in all samples by the decarburizing annealing, as could be shown by GDOES measurements. In all samples the metallographic analyses have shown a formation of martensite in the region of the material surface by targeted cooling and/or cold forming with simultaneous increase in strength in the border region of the workpiece.

Accordingly, a gradient-workpiece could be produced with targeted border decarburization by annealing at an oxidizing atmosphere.

Due to the reduced carbon content the thus heat treated steel has a meta-stable austenite in the border region which meta-stable austenite forms martensite in the subsequent cold forming and/or already by quenching and with this has a correspondingly high strength. In the core, a stable austenite with the initial carbon content is present which, after the forming has twins and a high ductility and a lower hardness.

A cold forming following the heat treatment lead to a martensite formation associated with a significant increase in hardness, due to the occurring TRIP effect.

It is known that carbon containing ferritic steel types are used for hardening or tempering, in order to achieve material properties of the workpiece surface and core. On the other hand, austenitic steel types cannot be tempered due to the material.

In carbon containing steel types it is also known that a border oxidation can occur during hardening or tempering which causes a scaling of the surfaces as well as a decarburization in surface proximate regions.

Usually, the decarburization is undesired because the material loses hardness in these regions. For this reason the maximal depth of the decarburization is limited in standards and customer specifications (for example quenched and tempered steel or ball bearings).

The present invention departs from this state of the art and takes the opposite path by using the decarburization of the austenitic lightweight steel in combination with accelerated cooling and/or a cold forming for increasing the hardness, with which different material properties can be established in the direction of the plate thickness.

In contrast to known composite materials made of ferritic steel types, material properties which depend on plate thickness can be realized in a simple and cost saving manner while retaining the weight advantages and the other advantageous properties of the lightweight steel. By means of the method according to the invention it is now possible to use high-alloyed austenitic lightweight steels for so called gradient material. The decarburization, i.e. the formation of a gradient material can be performed on the hot strip as well as the cold strip, wherein the thus treated strips can be provided with a metallic coating. Metallic coatings can for example be coatings which are based on Zn, as well as Mg or Al with different alloy proportions.

With such a gradient material, produced according to the invention, the field of use of known lightweight steels is significantly expanded especially in the filed of automobiles, wherein demand-optimized workpieces are used in combination with the advantages of the lightweight steels.

In addition, the gradient of the strength which can be established by the different structures, is important for the design of structures for example in the field of construction.

Targeted control of the annealing parameters (temperature, holding time) and the oxidizing annealing atmosphere (gas composition, partial pressure) during the heat treatment allows adjusting the degree of the decarburization and its depth from the workpiece surface.

For example, at longer annealing time and higher annealing temperature the decarburization is more intensive and affects a greater depth of the workpiece. The oxidizing annealing atmosphere can for example be air or oxygen or oxygen containing gases can be added, wherein the degree of the decarburization can be varied via the partial pressure level.

It is also possible to cause a decarburization under oxidizing annealing atmosphere by controlling the re-heating conditions before the hot rolling and/or between the hot roll pass (temperature, holding time). In combination with a reducing or inert annealing treatment the degree of the decarburization and its depth from the work piece surface can subsequently be adjusted accurately. For example, in case of a longer rolling time or incubation time in the furnace and higher rolling temperature, the decarburization becomes more intensive and affects a greater depth of the work piece.

The degree of the decarburization can be varied by the subsequent reducing or inert annealing treatment in that the border de-carbonized layer can be decreased again by compensation processes. This allows setting a gradient of the decarburization in a targeted manner across the thickness of the workpiece with corresponding properties after the subsequent targeted cooling and/or cold forming.

The cooling speed and the degree of forming influence the martensite formation, and with this the degree of hardening.

Such a material is particularly useful for applications in which a great surface hardness combined with a high tenacity is required such as for example for bullet proof components because the material has a high border hardness (martensite) with a very high energy absorption in the case of being fired on.

BRIEF DESCRIPTION OF THE DRAWING

Other features and advantages of the present invention will be more readily apparent upon reading the following description of currently preferred exemplified embodiments of the invention with reference to the accompanying drawing, in which.

Figure 1A:
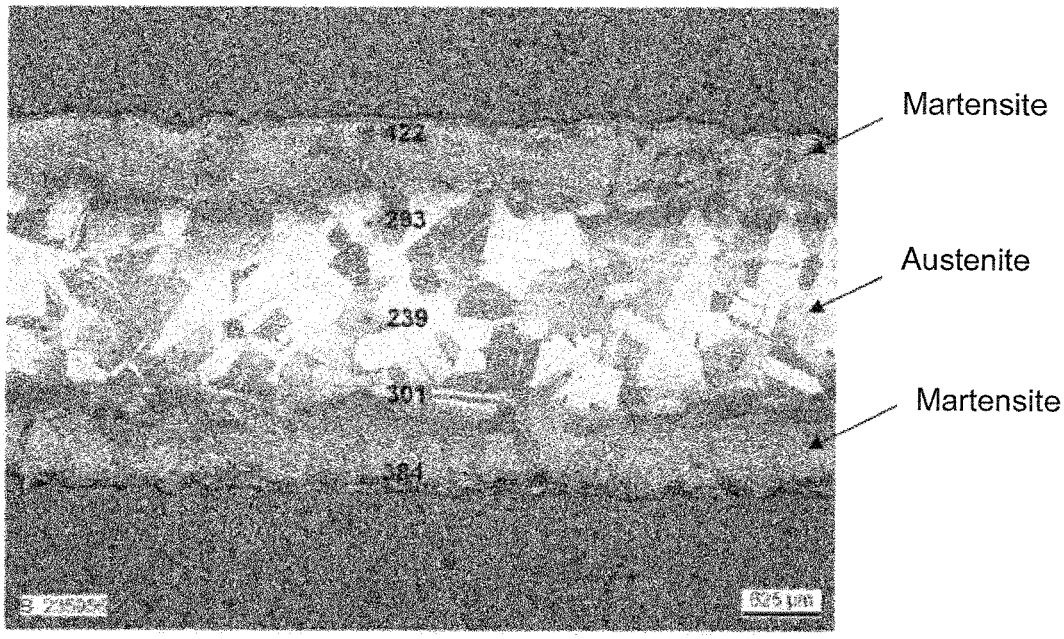
FIG. 1*a* shows a photograph of the structure of a workpiece according to the invention.
Figure 1B:
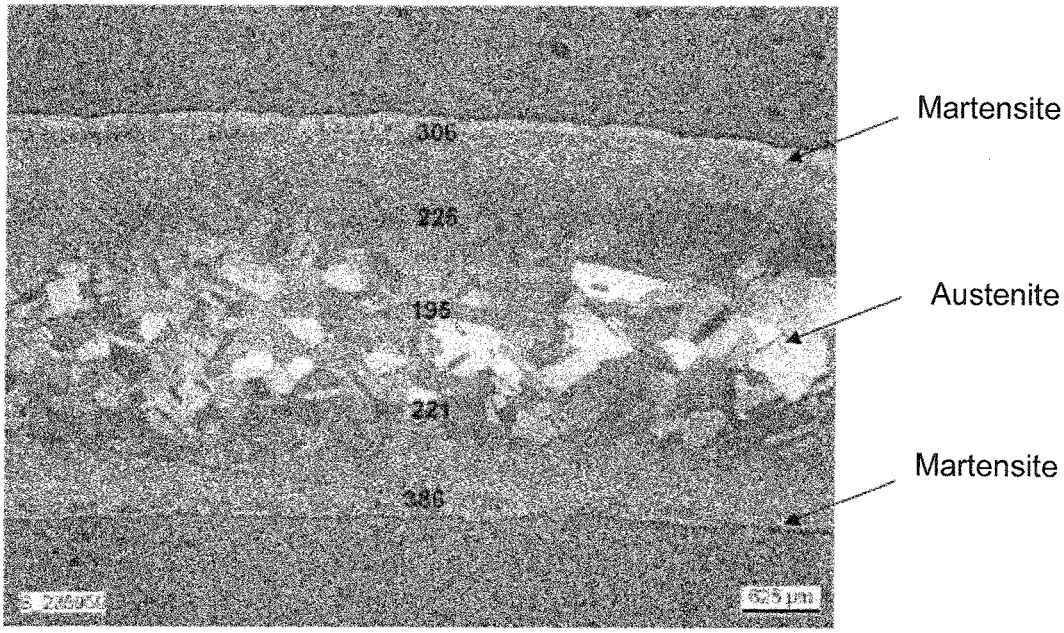
FIG. 1*b* shows another a photograph of the structure of a workpiece according to the invention.
Figure 1C:
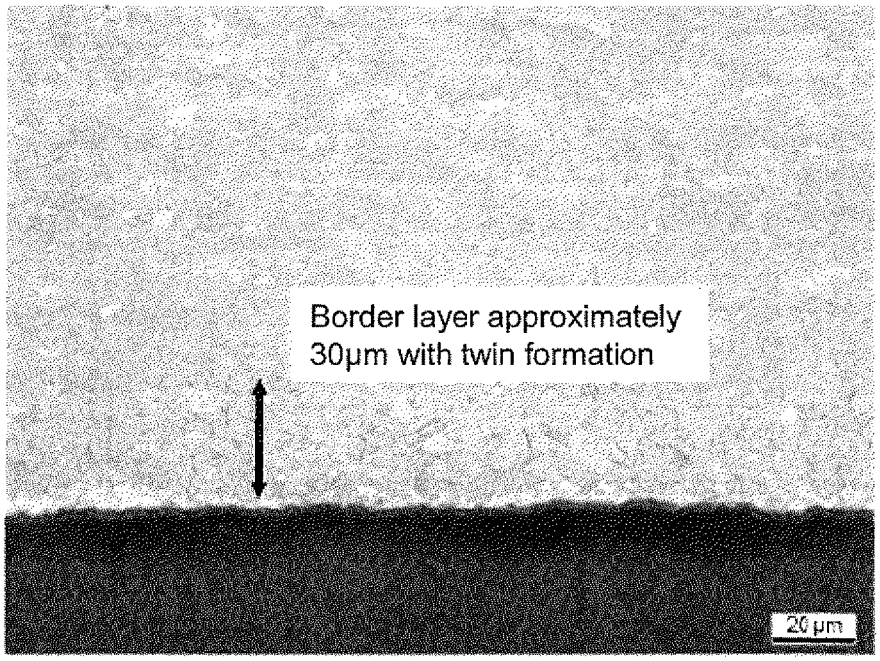
FIG. 1*c* shows another a photograph of the structure of a workpiece according to the invention.
Figure 1D:
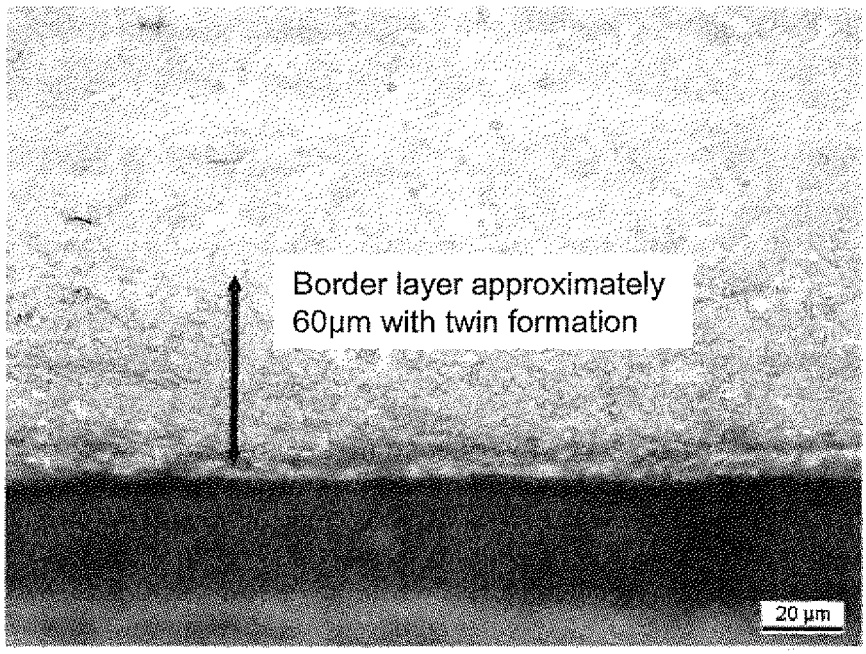
FIG. 1*d* shows another a photograph of the structure of a workpiece according to the invention.

The following alloy compositions were used in the operating tests In weight %:

| | FIG. 1a | FIG. 1b | FIG. 1c | FIG. 1d |
|---|---|---|---|---|
| C | 0.7 | 0.7 | 0.7 | 0.7 |
| Al | 2.5 | 2.5 | 2.5 | 2.5 |
| Si | 2.5 | 0.2 | 0.3 | 0.3 |
| Mn | 15 | 15 | 15 | 15 |

remainder iron including usual steel tramp elements

DETAILED DESCRIPTION OF PREFERRED EMBODIMENTS

Photographs of structures of workpieces which were treated according to the invention for martensite formation and corresponding measurements of hardness are shown in two pictures of structures (FIG. 1*a*, 1*b*). The materials differ here with regard to their Si-content. The pictures of the structure show a layer of martensite of different thickness in the surface proximate regions and the significant increase in hardness associated therewith compared to the austenite structure in the matrix. Here, the steel according to FIG. 1*a* shows a significantly greater increase in hardness than the steel according to FIG. 1*b*.

The oxidizing annealing treatment of the samples of FIGS. 1*a* and 1*b* which is required for decarburization was carried out under ambient pressure (air) at an annealing temperature of 1150° C. and an annealing time of 1 h. In the present case, the samples were not quenched after the annealing treatment but only subjected to a cold forming for verifying the TRIP-effect (formation of forming-induced martensite).

FIGS. 1*c* and 1*d* show that, depending on the degree of the decarburization, border regions with local twin formation can also be adjusted. A variation of the carbide formation across the plate thickness can also be adjusted in dependence on the degree of the decarburization.

The annealing treatment which is required for the decarburization of the samples in FIGS. 1*c* and 1*d* occurred during the hot rolling. After the subsequent cold rolling a reducing annealing retreatment with different temperatures (FIG. 1*c*: 750° C.—border layer 30 μm with twins, FIG. 1*d*: 700° C.—border layer 60 μm with twins).

In addition, work pieces made of lightweight steel have to satisfy relatively high demands with regard to workability for example by cold forming, welding and/or corrosion protection (for example zinc containing coatings).

When welding zinc-plated austenitic lightweight steels, the so called liquid metal embrittlement can cause problems. Here, the heating up of the basic material during welding leads to an infiltration of the grain boundaries by liquefied zinc material of the coating. This causes the basic material in the vicinity of the welding zone to lose strength and ductility so that the welding connection or the basic material which borders the welding connection no longer satisfies the demands on the mechanical properties which increases the risk of premature failure of the welding connection.

Tests have shown that when welding steels with high manganese content the grain border attack by the molten zinc material can be effectively avoided by formation of a martensitic or martensitic-austenitic mixed structure in the de-carbonized surface proximate regions. The surface proximate de-carbonized border layer is very well suited as intermediate layer to avoid the liquid metal embrittlement in zinc-plated lightweight steels.

The inventive idea is not only applicable for flat products such as hot and cold strip but also for profiled sections and pipes and components produced therefrom. All known methods of the cold, hot and warm forming can be used for the forming such as bending, deep-drawing, compressing, widening and so on. But also the known hydroforming or press form hardening. Thus, the production of gradient materials according to the invention can be achieved using the following process routes:

- Cold or hot forming of a workpiece such as for example a cut sheets to a component with subsequent oxidizing annealing of the component and subsequent targeted cooling for hardening the surface by transformation of he de-carbonized regions to martensite.
- Hydroforming of a pipe at elevated temperature, which allows a decarburization of the surface, with a final fast cooling (hardening).
- Hydroforming of a pipe at room temperature with final oxidizing annealing of the already formed component and subsequent fast cooling (hardening).
- Press form hardening of a work piece with an oxidizing annealing before the forming; forming at elevated temperature in the austenitic structure state and subsequent fast cooling for martensitic transformation of the surface proximate, de-carbonized regions.
- Oxidizing annealing for establishing a de-carbonized layer, for example of a steel plate with subsequent targeted cooling (without hardening) with subsequent cold forming.
- Oxidizing annealing for establishing a de-carbonized layer, for example of a steel plate with subsequent targeted cooling (without hardening) with subsequent cold rolling for targeted establishment of the hardening layer thickness via the formation of forming martensite.

Oxidizing annealing of for example a steel plate with subsequent targeted cooling (hardening) and direct application without further forming technical stress.

Oxidizing annealing in the course of the hot rolling process for establishing a de-carbonized layer with subsequent cold rolling.

Oxidizing annealing in the course of the hot rolling process for establishing of a de-carbonized layer with subsequent cold rolling and annealing under oxidizing atmosphere for further decarburization.

Oxidizing annealing in the course of the hot rolling process for establishing a de-carbonized layer with subsequent cold rolling and annealing under reducing or inert atmosphere fro decreasing or establishment of the decarburization by compensation processes.

The method according to the invention can generally be used for all alloys which are austenitic at room temperature, in particular however of high alloyed lightweight steels.

Advantageously, the method according to the invention for the first time offers the possibility to accommodate the specific demands on the material properties of the finished component by adjusting these properties across the strip thickness.

In summary, the following advantages result from the invention:

Establishment of required material properties via the wall thickness by simple decarburizing annealing with subsequent hardening or mechanical forming It can be influenced in a targeted manner:

Wear/abrasion/tribology
Scaling resistance
Corrosion protection
Coating properties
Bonding properties
Electrical properties
Weldability (for example resistance spot weldability)
Thermal properties (bimetal)
Optical properties (appearance)
Damping Realization of combinations of different surfaces and material properties

What is claimed is:

1. A Method for producing a workpiece having properties which are adjustable across a wall thickness or strip thickness of the workpiece, said workpiece being made of an austenitic lightweight steel which has an alloy composition comprising by weight percent 0.2% to 1% carbon,
0.05% to <15% aluminum,
0.05% to 6.0% silicon,
9% to <30% manganese,
and at least one element selected from the group consisting of chromium, copper, boron, titanium, zirconium, vanadium and niobium, chromium≤6.5%; titanium+zirconium≤0.7%; niobium+vanadium≤0.5%, boron≤1%, the remainder iron including common steel companion elements, said method comprising the steps of:

subjecting the workpiece to a decarburizing annealing treatment under an oxidizing atmosphere thereby causing a ferritic or meta-stable austenitic structure to form in a surface proximate region of the workpiece; and subjecting the workpiece to an accelerated cooling and/or a cold forming for generating an increased hardness in the surface proximate region and a property gradient of the workpiece, wherein a layer thickness and properties of the austenitic structure are adjustable via variation of at least one annealing parameter selected from the group consisting of temperature and holding time and via variation of at least one of a gas composition and a partial pressure of the atmosphere.

2. The method of claim 1, further comprising forming the workpiece before, during or after the annealing treatment.

3. The method of claim 2, wherein the forming is a hot or cold forming.

4. The method of claim 3, wherein the forming is a hot or cold rolling.

5. The method of claim 4, further comprising after the rolling process, subjecting the workpiece to an annealing process under a reducing or inert atmosphere to adjust a depth and a degree of a decarburization generated in the workpiece by the annealing treatment before and/or after individual rolling passes of the hot rolling.

6. The method of claim 4, further comprising adjusting a depth and a degree of a decarburization caused by the decarburizing annealing treatment in a targeted manner by reheating the workpiece between individual rolling passes of the hot rolling.

7. The method of claim 3, wherein the forming is a hydroforming.

8. The method of claim 3, wherein the forming is a deep drawing.

9. The method of claim 3, wherein the forming is a pressing.

10. The method of claim 3, wherein the forming is a press hardening.

11. The method of claim 2, wherein the forming is performed after the annealing treatment, and wherein the accelerated cooling is performed during the forming.

12. The method of claim 1, wherein the accelerated cooling is a quenching.

13. The method of claim 1, wherein the oxidizing annealing atmosphere is ambient air.

14. The method of claim 3, wherein oxygen or oxygen containing gases are added to the ambient air.

* * * * *